US010557622B2

(12) United States Patent
Highbridge

(10) Patent No.: US 10,557,622 B2
(45) Date of Patent: Feb. 11, 2020

(54) RECESSED LIGHTING FIXTURE WITH ORIENTATION ADJUSTING APPARATUS

(71) Applicant: RAB Lighting Inc., Northvale, NJ (US)

(72) Inventor: Doug Highbridge, Hopewell Junction, NY (US)

(73) Assignee: RAB Lighting Inc., Northvale, NJ (US)

( * ) Notice: Subject to any disclaimer, the term of this patent is extended or adjusted under 35 U.S.C. 154(b) by 89 days.

(21) Appl. No.: 15/434,252

(22) Filed: Feb. 16, 2017

(65) Prior Publication Data

US 2017/0234517 A1 Aug. 17, 2017

Related U.S. Application Data

(60) Provisional application No. 62/295,730, filed on Feb. 16, 2016.

(51) Int. Cl.

| | |
|---|---|
| ***F21V 21/26*** | (2006.01) |
| ***F21V 21/04*** | (2006.01) |
| ***F21V 23/00*** | (2015.01) |
| *F21Y 115/10* | (2016.01) |

(52) U.S. Cl.

CPC ..... *F21V 21/26* (2013.01); *F21V 21/047* (2013.01); *F21V 23/003* (2013.01); *F21Y 2115/10* (2016.08)

(58) Field of Classification Search

None

See application file for complete search history.

(56) References Cited

U.S. PATENT DOCUMENTS

| | | | |
|---|---|---|---|
| 3,027,452 | A | 3/1962 | McGinty |
| 4,887,196 | A | 12/1989 | Brown et al. |
| 5,412,542 | A | 5/1995 | Mandy |
| 5,944,412 | A | 8/1999 | Janos et al. |
| 6,082,878 | A | 7/2000 | Doubek et al. |

(Continued)

FOREIGN PATENT DOCUMENTS

| | | |
|---|---|---|
| CN | 202221021 | 5/2012 |
| EP | 2112431 | 7/2012 |
| GB | 2497925 | 3/2013 |

OTHER PUBLICATIONS

Office Action issued by the Canadian Patent Office dated Dec. 29, 2017 for App. No. 2,958,351.

(Continued)

*Primary Examiner* — Elmito Breval

(74) *Attorney, Agent, or Firm* — Frost Brown Todd LLC; Douglas G. Gallagher; Kevin C. Oschman

(57) ABSTRACT

A recessed light fixture and methods for manufacturing the same are disclosed. Embodiments include a support base and an adjusting bracket pivotally connected to the support base, the support base capable of pivoting between a first pivot position and a second pivot position to facilitate a user moving the adjusting bracket. When a lighting source is connected to the adjusting bracket, a user is able to move the lighting source and bracket aside to facilitate the user accessing the region behind the lighting source and bracket, which can include a power supply box and door. In at least one embodiment, a single-blade bracket extends perpendicularly from the support base while in the first pivot position and does not extend perpendicularly from the support base while in the second pivot position.

20 Claims, 9 Drawing Sheets

(56) References Cited

U.S. PATENT DOCUMENTS

| | | | |
|---|---|---|---|
| 6,491,407 | B1 | 12/2002 | Beadle |
| 6,543,915 | B1 | 4/2003 | Chen |
| 7,186,008 | B2 | 3/2007 | Patti |
| 7,234,674 | B2 | 6/2007 | Rippel et al. |
| 7,303,314 | B2 | 12/2007 | Jones |
| 7,434,967 | B2 | 10/2008 | Dupre |
| 7,438,433 | B1 | 10/2008 | Steadman et al. |
| 7,559,677 | B1 | 7/2009 | Dupre |
| 7,789,533 | B2 | 9/2010 | Von Preyss et al. |
| 7,874,709 | B1 | 1/2011 | Beadle |
| 8,002,425 | B2 | 8/2011 | Russo et al. |
| 8,021,013 | B2 | 9/2011 | Russo et al. |
| 8,215,805 | B2 | 7/2012 | Cogliano et al. |
| 8,328,382 | B2 | 12/2012 | Crooks et al. |
| 8,636,387 | B1 | 1/2014 | Wronski et al. |
| 8,727,583 | B2 | 5/2014 | Russo et al. |
| 8,777,459 | B2 | 7/2014 | Patti et al. |
| 8,820,985 | B1 | 9/2014 | Tam et al. |
| 2006/0262542 | A1 | 11/2006 | Ibbitson et al. |
| 2010/0103685 | A1 | 4/2010 | Austin |
| 2010/0110698 | A1* | 5/2010 | Harwood ..... F21V 21/04 362/365 |
| 2015/0241038 | A1* | 8/2015 | Fryzek ..... F21V 21/047 362/147 |

OTHER PUBLICATIONS

Chinese Office Action dated Apr. 28, 2019 for CN Application No. 201710084090.0.

Chinese office action for Application No. CN 201710084090.0.

* cited by examiner

RECESSED LIGHTING FIXTURE WITH ORIENTATION ADJUSTING APPARATUS

CROSS-REFERENCE TO RELATED APPLICATIONS

This application claims the benefit of U.S. Provisional Application No. 62/295,730, filed Feb. 16, 2016, titled RECESSED LIGHTING FIXTURE WITH ORIENTATION ADJUSTING APPARATUS, the entirety of which is hereby incorporated herein by reference.

TECHNICAL FIELD

Embodiments of this disclosure relate generally to lighting fixtures and, more particularly, to an improved recessed lighting fixture with orientation adjustment and access features.

BACKGROUND

Recessed lighting fixtures can be used to install a light into a surface, such as ceilings, and to permit the aiming of the light relative to the surface into which the recessed fixture is installed. Light emitting diodes (LEDs) have become an increasingly popular lighting source in various luminaires, including recessed fixtures. LEDs have been recognized as providing increased efficiency and decreased costs relative to conventional lighting sources and can offer other advantages including long life, compact size, and direct illumination.

For purposes of inspection, repair, and replacement, it can be desirable to obtain access to an electrical supply and/or driver compartment of a recessed lighting fixture, including an LED recessed lighting fixture. However, it was realized by the inventors of the present disclosure that the aiming mechanism of the aimable light source designs in the known art interferes with the ability to access the electrical supply compartment. As such, access of the electrical supply compartment and LED driver generally requires removal of the light fixture or removal of the light source. It was appreciated by the inventors of the present disclosure that advantages can be realized by providing a recessed lighting fixture with increased efficiency and decreased costs relative to conventional lamp sources, and also provide an aimable light source that provides improved access to the electrical supply compartment. The present disclosure is responsive to at least such an endeavor and at least some embodiments are directed to one or more of the problems or issues set forth above, and may be directed to other problems as well.

SUMMARY

Embodiments of the present disclosure provide an improved recessed lighting fixture with features such as lighting orientation adjustment and improved accessibility.

In accordance with one embodiment of the present disclosure, a recessed lighting fixture can include a support base with an opening to allow passage of light from a light source. An adjusting bracket can be configured to support the light source and can be connected to the support base in such a way that it is able to pivot between a first pivot position and a second pivot position. The adjusting bracket can extend perpendicularly from the plane to provide illumination through the support base while in the first pivot position and not extend perpendicularly from the plane to provide access clearance to an electrical supply compartment while in the second pivot position.

The recessed lighting fixture of the present disclosure can include additional features to allow for a wider range of angles the light is emitted through the opening. For example, a slot can be included in the adjusting bracket which can provide a slidable connection for the light source to move about the adjusting bracket. This slidable connection can allow adjustment of the angle that the light is emitted through the opening from a light source. Detents can be included in the slot which can provide preset directional placement of a light source. Further, the support base can rotatably connect to an adjusting plate to allow rotational adjustment of the adjusting bracket. This rotational feature can provide a greater range of angles for emitting light as well as improve accessibility to the light source and its components.

In accordance with another embodiment of the present disclosure, a recessed lighting fixture can include a base defining a plane and an adjusting bracket pivotally connected to the base. The adjusting bracket can pivot between a first pivot position and a second pivot position with the adjusting bracket extending perpendicularly from the plane in the first pivot position and extending in a direction that is not perpendicular from the plane in the second pivot position.

In accordance with still another embodiment, a recessed lighting support bracket can include a base and a support bracket hinged to the base. The connection between the base and the support bracket can include at least one hinge and can be configured to support a light source. The support bracket can also rotate about the at least one hinge between a first rotated position and a second rotated position.

In accordance with yet another embodiment, a method of manufacturing a recessed lighting fixture can include providing a support base with an opening to allow passage of light from a light source and providing an adjusting bracket configured to support the light source. The method can also include connecting the light source to the adjusting bracket to provide variable positions for aiming the light source. The method can also include connecting the adjusting bracket to the support base using a hinged connection to permit pivoting of the adjusting bracket into a plurality of pivot positions relative to the support base.

This summary is provided to introduce a selection of the concepts that are described in further detail in the detailed description and drawings contained herein. This summary is not intended to identify any primary or essential features of the claimed subject matter. Some or all of the described features may be present in the corresponding independent or dependent claims, but should not be construed to be a limitation unless expressly recited in a particular claim. Each embodiment described herein does not necessarily address every object described herein, and each embodiment does not necessarily include each feature described. Other forms, embodiments, objects, advantages, benefits, features, and aspects of the present disclosure will become apparent to one of skill in the art from the detailed description and drawings contained herein. Moreover, the various apparatuses and methods described in this summary section, as well as elsewhere in this application, can be expressed as a large number of different combinations and sub-combinations. All such useful, novel, and inventive combinations and sub-combinations are contemplated herein, it being recognized that the explicit expression of each of these combinations is unnecessary.

BRIEF DESCRIPTION OF THE DRAWINGS

Some of the figures shown herein may include dimensions or may have been created from scaled drawings. However, such dimensions, or the relative scaling within a figure, are by way of example, and not to be construed as limiting.

DETAILED DESCRIPTION OF THE ILLUSTRATED EMBODIMENTS

Figure 1:
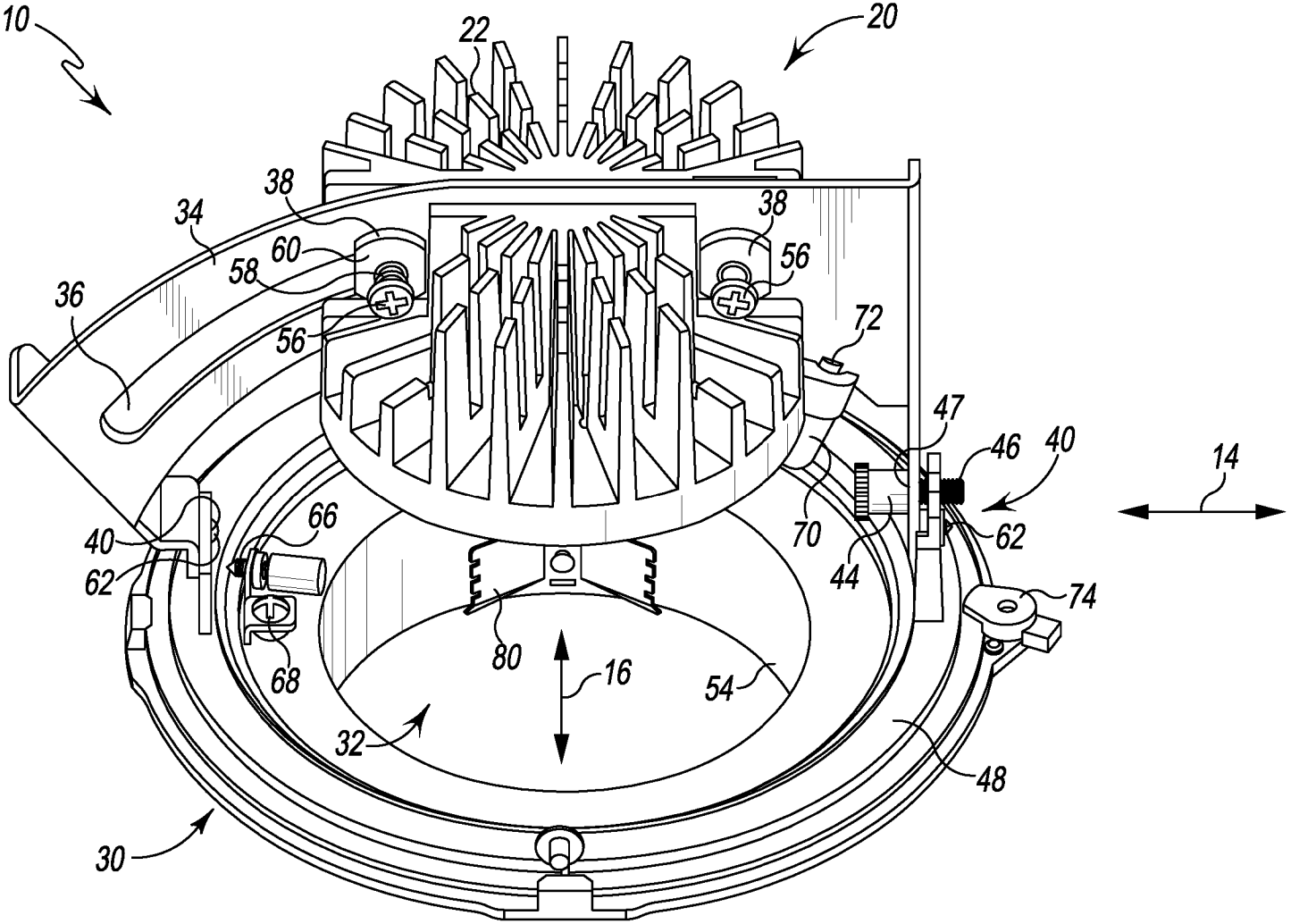
FIG. 1 is a perspective view of one embodiment of the present disclosure.
Figure 2:
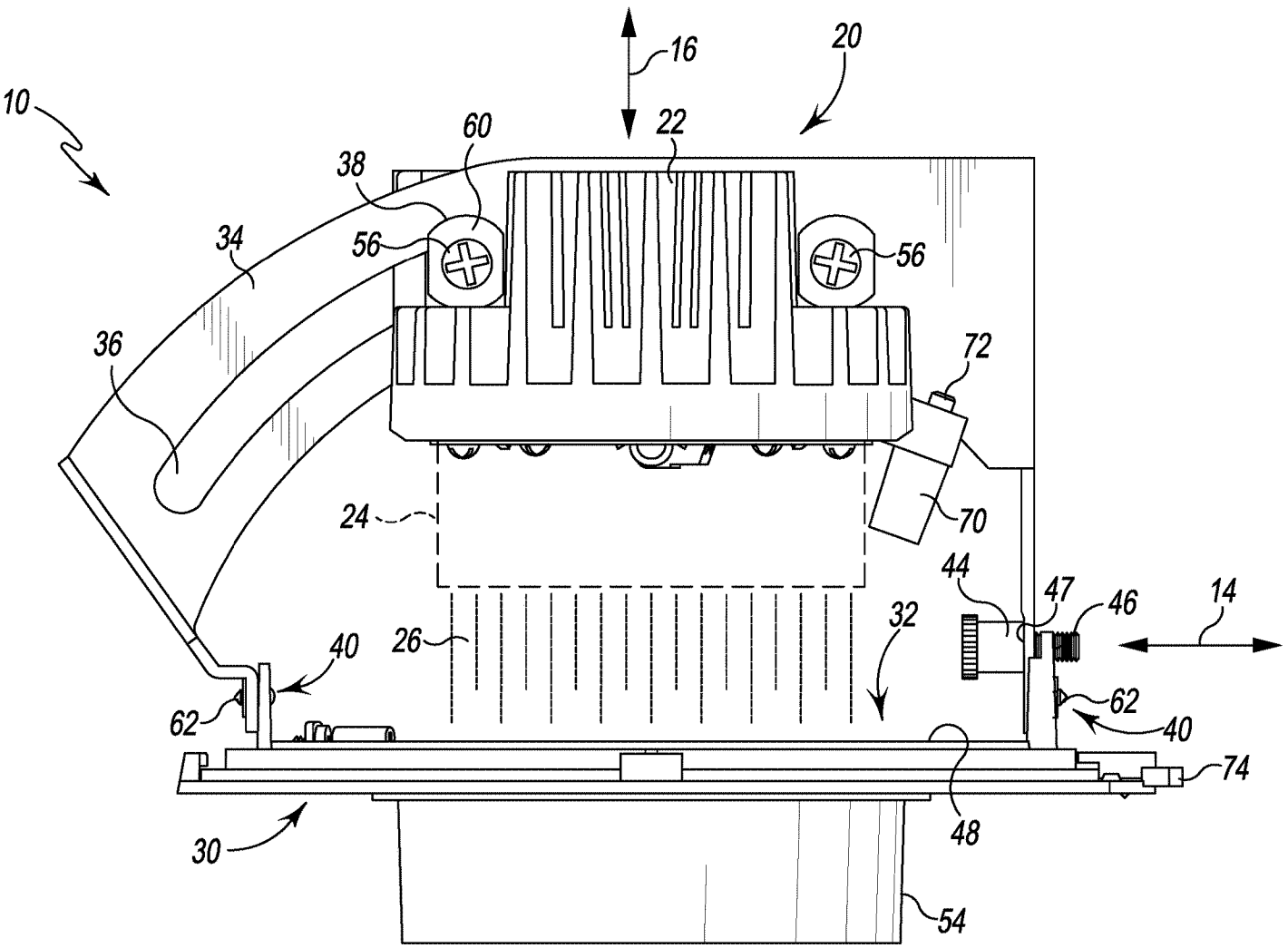
FIG. 2 is a front plan view of the embodiment shown in FIG. 1.
Figure 3:
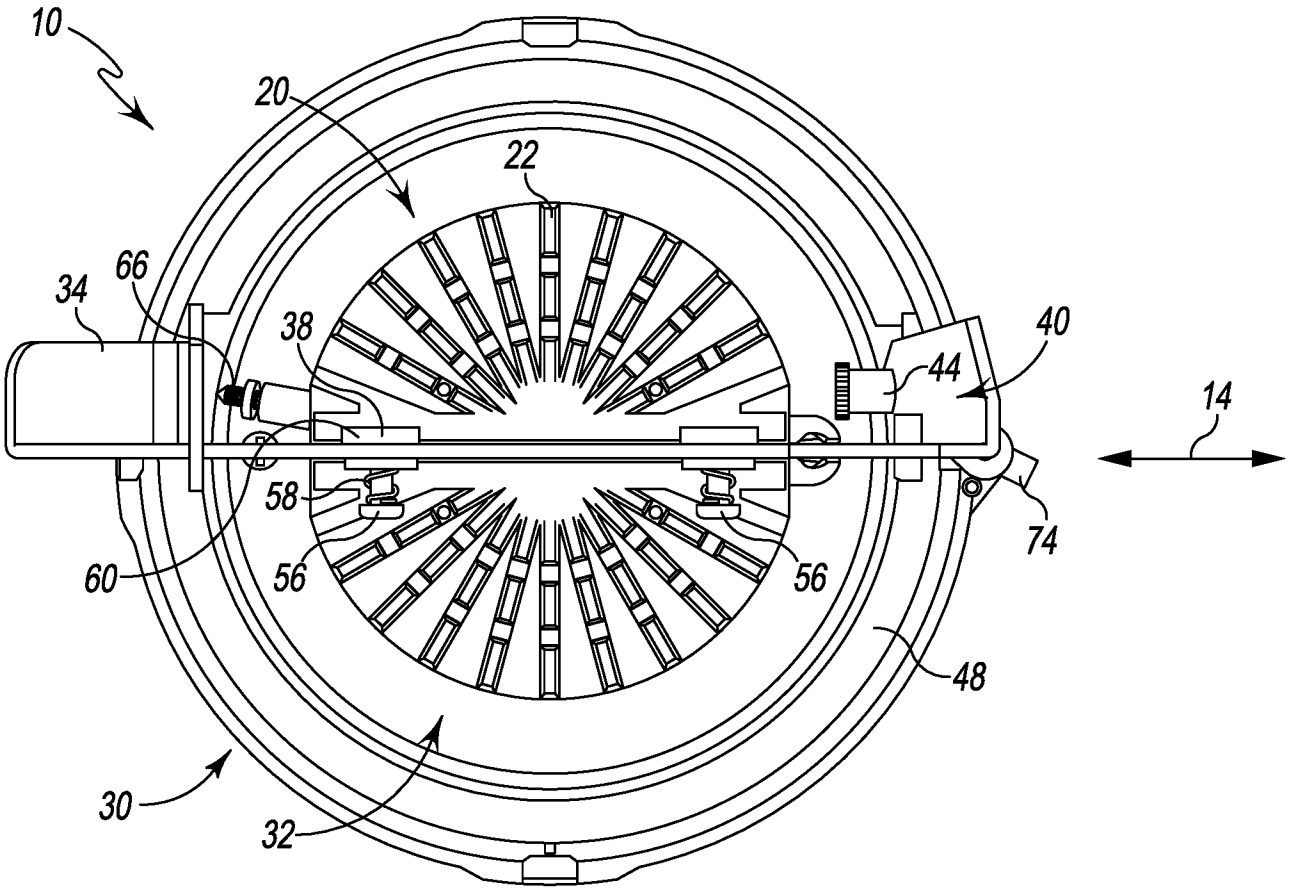
FIG. 3 is a top plan view of the embodiment shown in FIG. 1.
Figure 4:
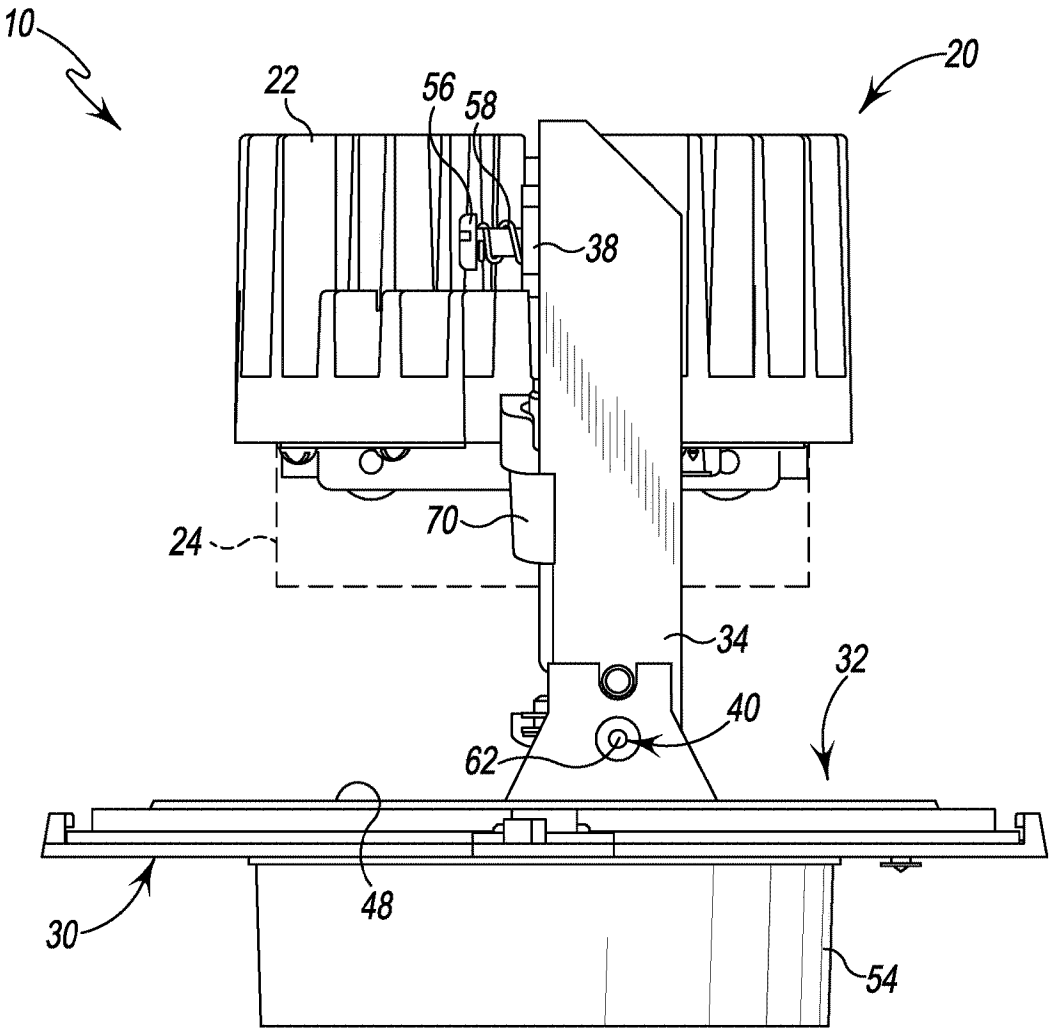
FIG. 4 is a right side plan view of the embodiment shown in FIG. 1 in a first position.

For the purposes of promoting an understanding of the principles of the disclosure, reference will now be made to one or more embodiments, which may or may not be illustrated in the drawings, and specific language will be used to describe the same. It will nevertheless be understood that no limitation of the scope of the disclosure is thereby intended; any alterations and further modifications of the described or illustrated embodiments, and any further applications of the principles of the disclosure as illustrated herein are contemplated as would normally occur to one skilled in the art to which the disclosure relates. At least one embodiment of the disclosure is shown in great detail, although it will be apparent to those skilled in the relevant art that some features or some combinations of features may not be shown for the sake of clarity.

Any reference to "invention" within this document is a reference to an embodiment of a family of inventions, with no single embodiment including features that are necessarily included in all embodiments, unless otherwise stated. Furthermore, although there may be references to benefits or advantages provided by some embodiments, other embodiments may not include those same benefits or advantages, or may include different benefits or advantages. Any benefits or advantages described herein are not to be construed as limiting to any of the claims.

Likewise, there may be discussion with regards to "objects" associated with some embodiments of the present invention, it is understood that yet other embodiments may not be associated with those same objects, or may include yet different objects. Any advantages, objects, or similar words used herein are not to be construed as limiting to any of the claims. The usage of words indicating preference, such as "preferably," refers to features and aspects that are present in at least one embodiment, but which are optional for some embodiments.

Specific quantities (spatial dimensions, temperatures, pressures, times, force, resistance, current, voltage, concentrations, wavelengths, frequencies, heat transfer coefficients, dimensionless parameters, etc.) may be used explicitly or implicitly herein, such specific quantities are presented as examples only and are approximate values unless otherwise indicated.

The embodiments of the present disclosure provide a recessed lighting fixture that enables a user to move the light emitting device to facilitate the user accessing a region normally blocked by the light emitting device, which can allow the user to access a recessed component or compartment. In at least one embodiment a bracket configured to support the light emitting device is hinged, allowing the user to move the bracket and the attached light emitting device sufficiently to permit opening of an access door for a compartment housing the driver for the light emitting device.

Depicted in FIGS. 1-5 is a recessed lighting fixture 10 according to at least one embodiment of the present disclosure. Lighting fixture 10 includes a base member (e.g., support member 30) and a bracket (e.g., support bracket 34) pivotally connected to the base and configured to connect to a light source (e.g., light source 20). Support member 30 can define a plane and can include an opening 32 through which light 26 (shown in FIG. 2) is emitted or directed from the light source 20. The support member 30 may include a peripheral edge 54 for abutting the area adjacent a hole made in a ceiling or wall, which can support the recessed installation. Of course, other embodiments can include other mounting strategies for the recessed lighting fixture 10. The support member 30 may also include one or more torsion brackets 80 configured to accept a trim or retrofit assembly.

The illustrated adjusting bracket or support bracket 34 can define one or more slots, such as the depicted slot 36 (which may include curved or straight portions), to which the light source 20 is coupled by a slidable connection 38. In the illustrated embodiment, the support bracket is planar (e.g., substantially flat) along the length of the slot 36, and the ends of the support bracket are bent to provide structure for locating a pivoting or hinged connection 40. In one embodiment, the slidable connection 38 includes one or more adjusting pins 56 and, optionally, springs 58 to provide tension against one or more contact plates 60. Each screw can be adjusted to increase or decrease the spring tension against the associated one or more contact plates, thereby altering the relative ease of sliding the light source 20 through the slot 36. Adjustment of the light source 20 through the slot 36 moves the light source 20 along a path defined by the slot 36, thereby altering the angle of the light 26 emitted by the light source 20 through the opening 32. However, it should be appreciates that alternative adjustable positions of the light source 20 are contemplated, particularly for providing directional adjustment of the light source 20 relative to the opening 32. The light source 20 of the disclosure can be centrally coupled to the slot 36 with a single slidable connection to provide balance and to ease movement of the light source 20 along the adjusting bracket 34.

Figure 7:
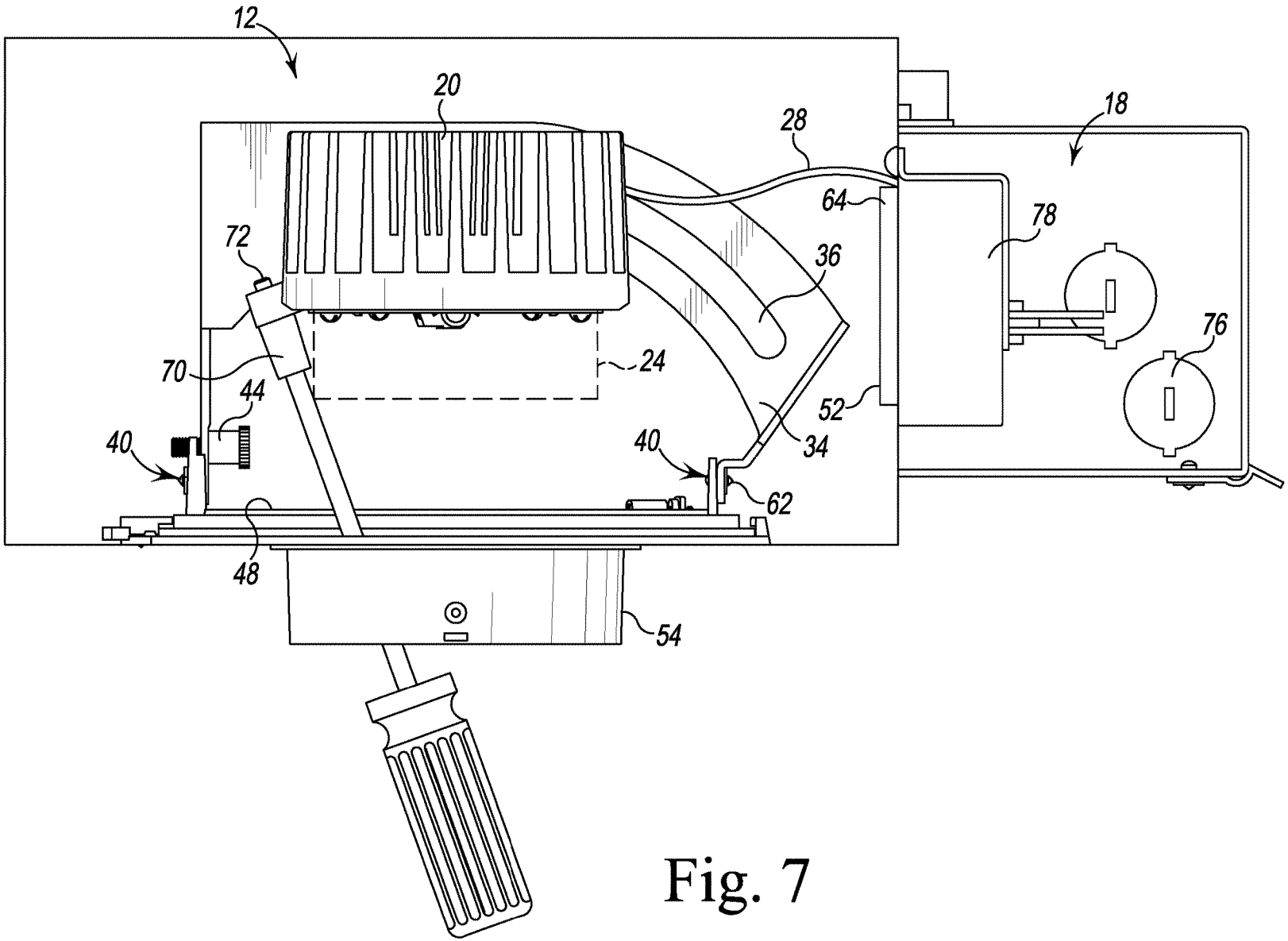
FIG. 7 is a side cut-away view of the embodiment shown in FIG. 6 in a first adjustment position.
Figure 8:
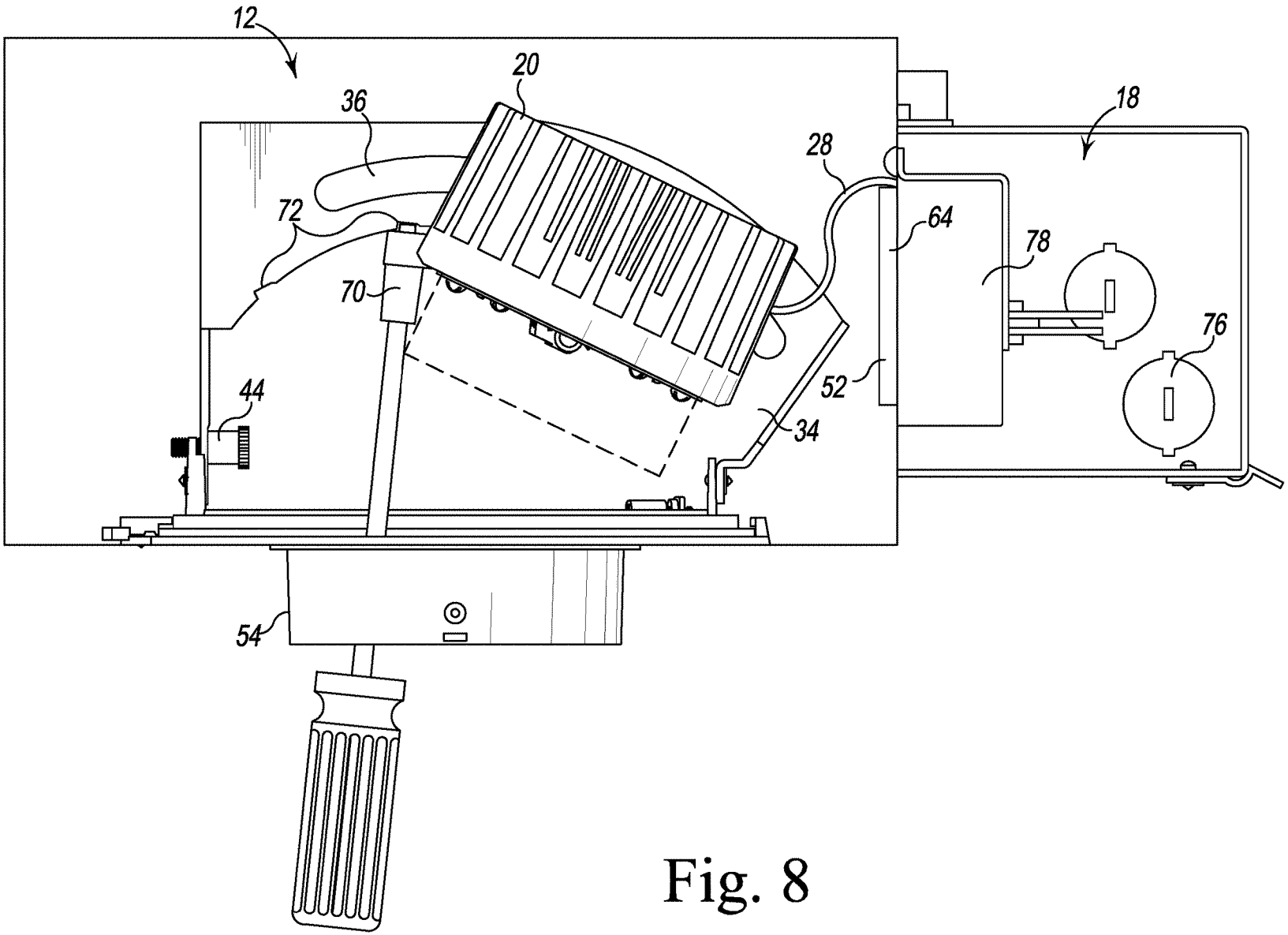
FIG. 8 is a side cut-away view of the embodiment shown in FIG. 6 in a second adjustment position.
Figure 9:
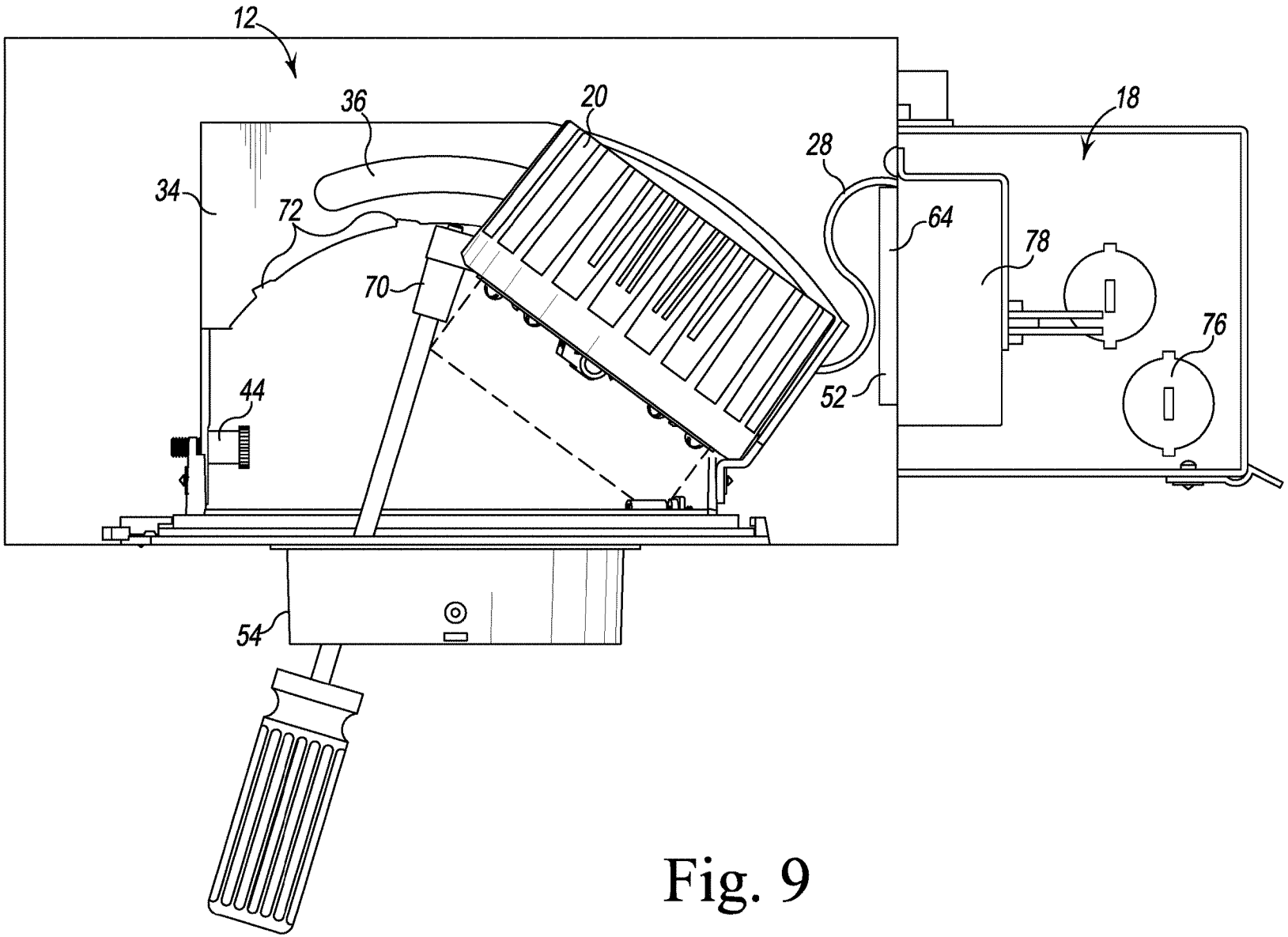
FIG. 9 is a side cut-away view of the embodiment shown in FIG. 6 in a third adjustment position.

Although the depicted embodiment illustrates a single-blade adjusting bracket 34 which allows the light source 20 to move through a single slot 36, which can have advantages in reducing the calibration or coordinated precision associated with dual-blade, dual-slot and gimbaled designs, alternate embodiments can include dual adjusting brackets 34 and dual-slot designs. The adjusting bracket 34 may also include one or more detents 72 to provide the capability of aiming the light source at a preset angle through the opening 32. FIGS. 7 through 9 illustrate three common lighting angles up to approximately 45 degrees relative to the opening 32 which may be desired. The adjusting bracket 34 and detents 72 can provide easy positioning of the light 26 to these common angles. A pin 70 or other fastening device (e.g. a threaded connector) can be inserted into a detent 72 to set the light source to the desired position on the adjusting bracket 34.

The illustrated adjusting bracket 34 is connected to the support member 30 in such a manner that the adjusting bracket 34 is able to pivot or hinge about an axis parallel to the plane defined by the support base, e.g., axis 14, between at least first and second pivot positions. In the illustrated embodiment, this pivoting or hinged connection 40 of the adjusting bracket 34 to the support member 30 is accomplished by two connectors 62 (e.g. rivet-type connectors or hinged connectors), each on opposing sides of the bracket 34 and support member 30.

The illustrated lighting fixture 10 can include a housing 12, and the housing 12 can further define at least one access hole 52 through which an electrical supply compartment 18 can be accessed as depicted in FIGS. 6 through 9. The electrical supply compartment 18 may house a lighting device driver 78. Most or all of the components of the recessed lighting fixture 10, including housing 12 and electrical supply compartment 18, may be recessed within or relative to a ceiling, wall, hole, or other similar structure.

In one embodiment of the disclosure, a light source 20 is attached to adjusting bracket 34 and can include a heat sink 22 and lens holder 24 (lens holder 24 is not depicted in FIG. 1). The illustrated light source 20 can utilize a light emitting diode (LED) emitter with a driver 78 to emit light 26. An electrical connection 28 (see, e.g., FIGS. 7 through 9) can electrically connect the light source 20 to the electrical components within the electrical supply compartment 18. In at least one embodiment, a lighting device driver 78 (see, e.g., FIGS. 7 through 9) is contained within the electrical supply compartment 18 and powers the light source 20. The electrical supply compartment 18 may further include one or more knockout covers 76 to allow easier access for wiring or lighting control. Although an LED light source is illustrated and described, it should be appreciated that alternative light sources may be used in the recessed lighting fixture 10 of the present disclosure.

Figure 5:
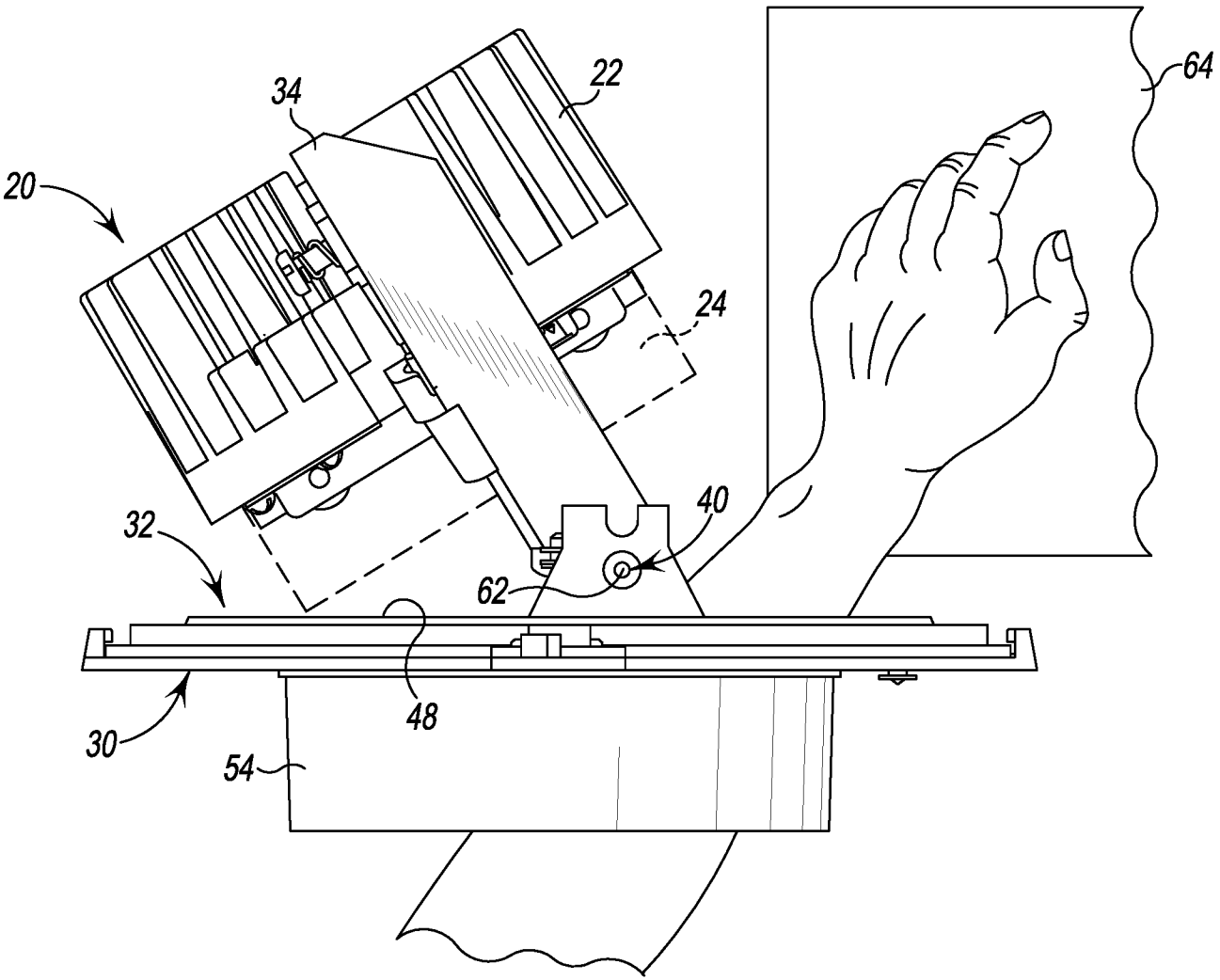
FIG. 5 is a right side plan view of the embodiment shown in FIG. 1 in a second position.
Figure 6:
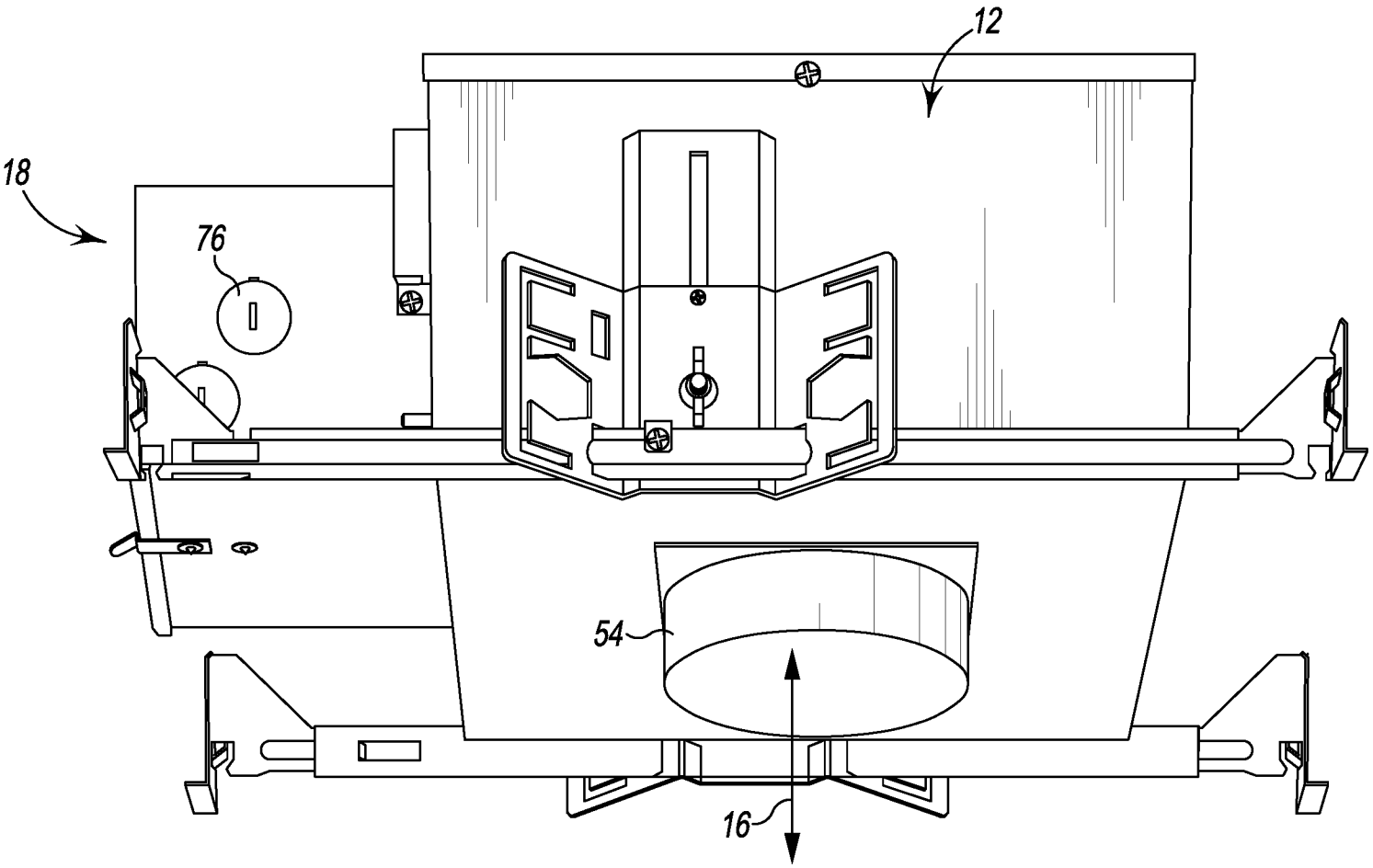
FIG. 6 is a bottom perspective view of the embodiment shown in FIG. 1 positioned in a housing and connected to an electrical supply compartment.

The pivoting or hinging motion of the adjusting bracket 34 allows the light source 20 to swing to one side of the lighting fixture 10 to facilitate selective access to the space surrounding the mounting area, which can include selective access to the electrical supply compartment 18. FIGS. 1-4 and 7-9 illustrate embodiments where the adjusting bracket 34 is in a first pivot position for routine use of the lighting fixture 10 to provide illumination with the light source 20 through the opening 32, while FIG. 5 shows the adjusting bracket 34 in a second pivot position for maintenance and access clearance to the electrical supply compartment 18 via the access hole 52 (see FIG. 7) defined by the housing 12. The adjusting bracket 34 can be placed into other pivot positions, which can allow for the adjusting bracket 34 or any associated elements (e.g., a light source 20, heat sink 22, or lens holder 24) to rest on the support member 30. In at least one embodiment, access to the electrical supply compartment 18 may be further facilitated by an access door 64 separating the electrical supply compartment 18 and housing 12. As shown in FIG. 5, the adjusting bracket 34 in a second pivot position allows access door 64 to be opened to provide access to the electrical supply compartment 18 through the access door 64.

A connector 44 (e.g., a threaded connector, push pin connector, or spring plunger) may be used to maintain a select orientation between the support member 30 and the adjusting bracket 34. For example, the adjusting bracket 34 and support member 30 can define coordinated openings 46 and 47, respectively, through which the connector 44 is inserted. The connector 44 provides a means to selectively lock the adjusting bracket 34 in place relative to axis 14, which can include locking the adjusting bracket 34 in a first pivot position for normal, routine use of the lighting fixture 10. Alternatively, the connector 44 may be retracted or removed from at least opening 46 to allow the adjusting bracket 34 to pivot or hinge relative to the support member 30.

The adjusting bracket 34 and associated adjusting slot 36 can allow adjustment of the light source 20 to, for example, approximately 45 degrees from central axis 16 (see FIG. 9). Adjustment in another direction can accomplished by rotating a rotating base (e.g., support base 48), which is rotatably connected to the support base 30, about a central axis 16 defined by opening 32. That is, rotation of the support base 48 relative to the housing 12 provides directional adjustment of the light source relative to the opening 52. In one embodiment, a friction member 66 (e.g., a threaded connector or adjustment wheel) may be used to adjust the friction between the support base 30 and support base 48. Tightening of the friction member 66 can inhibit rotational movement, whereas loosening the connection can allow for easier rotational repositioning of the support base 48. The illustrated locking clamp 74 can also be used to restrict rotational movement of the support base 48 by inserting a connector (e.g. a threaded connector) through the clamp to apply pressure between the support base 48 and support base 30. In other embodiments, this rotation of the support base 48 may be facilitated by an adjustment wheel (not pictured) attached to the support base 30, engaged with support base 48, and easily accessible by a user through opening 32 to rotate the adjustment wheel, which will rotate support base 48.

The adjusting bracket 34 and associated adjusting slot 36 can allow adjustment of the light source 20 to, for example, approximately 45 degrees from central axis 16 (see FIG. 9). Adjustment in another direction can accomplished by rotating a rotating base (e.g., rotating plate 48), which is rotatably connected to the support base 30, about a central axis 16 defined by opening 32. That is, rotation of the rotating plate 48 relative to the housing 12 provides directional adjustment of the light source relative to the opening 52. In one embodiment, a friction member 66 (e.g., a threaded connector or adjustment wheel) may be used to adjust the friction between the support base 30 and rotating plate 48. Tightening of the friction member 66 can inhibit rotational movement, whereas loosening the connection can allow for easier rotational repositioning of the rotating plate 48. The illustrated locking clamp 74 can also be used to restrict rotational movement of the rotating plate 48 by inserting a connector (e.g. a threaded connector) through the clamp to apply pressure between the rotating plate 48 and support base 30. In other embodiments, this rotation of the rotating plate 48 may be facilitated by an adjustment wheel (not pictured) attached to the support base 30, engaged with plate 48, and easily accessible by a user through opening 32 to rotate the adjustment wheel, which will rotate plate 48.

The lighting fixture of the present disclosure provides for the use of a cost-efficient LED light source in a recessed adjustable light fixture while maintaining simple access to the LED driver and/or electrical supply compartment. In the illustrated embodiment, energy and cost efficient recessed LED lighting fixture 10 provides aiming of light 26 and accessibility to electrical supply compartment 18.

Lighting fixture 10 can be mounted via a recessed mount into a hole or wall and includes a light source 20 that can be adjusted about multiple axes relative to the lighting fixture 10 to change the orientation of the emitted light 26. The electrical supply compartment 18 can be accessed by pivoting the adjusting bracket 34 away from the access hole 52. The adjusting bracket 34 can be unlocked and tilted out of the way by disengaging the connector 44 from the opening 46 in the adjusting bracket 34.

Various Aspects of Different Embodiments of the Present Disclosure are Expressed in Statements 1, 2, and 3, as Follows:

Statement 1. One embodiment of the present disclosure includes a recessed lighting fixture including a base defining a plane and an adjusting bracket pivotally connected to the base and pivoting between a first pivot position and a second pivot position, wherein the adjusting bracket extends perpendicularly from the plane in the first pivot position and extends in a direction that is not perpendicular from the plane in the second pivot position.

Statement 2. Another embodiment of the present disclosure includes a recessed lighting support bracket including a base and a support bracket hinged to the base by at least one hinge and configured to support a light source, wherein the support bracket rotates about the at least one hinge connecting the base to the support bracket between a first rotated position and a second rotated position.

Statement 3. Another embodiment of the present disclosure includes a method of manufacturing a recessed lighting fixture, including the acts of: providing a support base; providing an adjusting bracket configured to support a light source; and connecting the adjusting bracket to the support base using a hinged connection.

Yet Other Embodiments Include the Features Described in any of the Previous Statements 1, 2 or 3, as Combined with (i) one or more of the previous Statements 1, 2 or 3, (ii) one or more of the following aspects, or (iii) one or more of the previous Statements 1, 2 or 3 and one or more of the following aspects:

An opening in the base to allow passage of light from a light source.

Wherein the adjusting bracket is pivotally connected to the base about a single axis.

A connector selectively locking the adjusting bracket relative to the base.

A supporting member, wherein the base is rotatably disposed on the supporting member and is rotatable about a central axis defined by an opening in the base.

Wherein rotation of the supporting member about the central axis provides directional adjustment of a light source relative to an opening in the base.

A light source slidably coupled to a slot defined by the adjusting bracket facilitating movement of the light source relative to an opening in the base.

A lighting device driver electrically coupled to the light source.

Wherein the adjusting bracket is pivotally connected to the base using a hinge pin.

An opening in the base defining a central axis.

Wherein the support bracket intersects the central axis in the first rotated position and does not intersect the central axis in the second rotated position.

A light source slidably coupled to a slot defined by the support bracket facilitating movement of the light source relative to the opening.

Wherein the slot includes at least one detent capable of accepting a pin to secure the light source in a preset position.

Wherein the slot has a length and the support bracket is planar along the length of the slot.

A supporting member, wherein the base is rotatably disposed on the supporting member and is rotatable about the central axis.

Wherein connecting the adjusting bracket to the support base provides the capability of pivoting the adjusting bracket into a plurality of pivot positions relative to the support base.

Connecting the light source to the adjusting bracket.

Wherein the a support base includes an opening to allow passage of light from a light source.

Wherein connecting the light source to the bracket provides variable positions for aiming the light source.

Inserting a connector between the adjusting bracket and the support base to secure the adjusting bracket.

Providing a slot in the adjusting bracket to allow movement of the light source relative to the opening.

Rotatably connecting a support member to the support base, wherein the support member rotates about a central axis defined by the opening.

Wherein the adjusting bracket is a single-blade design with no more than one single-blade adjusting bracket.

Wherein the support bracket is a single-blade design with no more than one single-blade support bracket.

Wherein the adjusting bracket is a dual-blade design with two single-blade adjusting brackets.

Wherein the support bracket is a dual-blade design with two single-blade support brackets.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

Reference systems that may be used herein can refer generally to various directions (e.g., upper, lower, forward, rearward, horizontal, and vertical), which are merely offered to assist the reader in understanding the various embodiments of the disclosure and are not to be interpreted as limiting.

While examples, one or more representative embodiments and specific forms of the disclosure have been illustrated and described in detail in the drawings and foregoing description, the same is to be considered as illustrative and not restrictive or limiting. The description of particular features in one embodiment does not imply that those particular features are necessarily limited to that one embodiment. Some or all of the features of one embodiment can be used in combination with some or all of the features of other embodiments as would be understood by one of ordinary skill in the art, whether or not explicitly described as such. One or more embodiments have been shown and described, and all changes and modifications that come within the spirit of the disclosure are desired to be protected.

What is claimed is:

1. A recessed lighting fixture, comprising:

a base defining a base plane, the base being configured to rotate about an axis perpendicular to the base plane; and an adjusting bracket pivotally connected to the base and pivoting between a first pivot position and a second pivot position, wherein the adjusting bracket includes a plurality of mounting locations configured to support a light source and defining a base plane, wherein moving the light source from one of the plurality of mounting locations to another of the plurality of mounting locations alters the angle of the light emitted by the light source in relation to the adjusting bracket, and wherein the adjusting bracket extends perpendicularly from the plane in the first pivot position and moves in a direction perpendicular to the base plane of mounting locations to extend in a direction that is not perpendicular from the plane in the second pivot position.

2. The recessed lighting fixture of claim 1, comprising:

an opening in the base to allow passage of light from the light source.

3. The recessed lighting fixture of claim 2, comprising:

a supporting member;

wherein the base is rotatably disposed on the supporting member and is rotatable about a central axis defined by the opening.

4. The recessed lighting fixture of claim 3, wherein rotation of the base about the central axis provides directional adjustment of the light source relative to the opening for directional adjustment of light from the light source.

5. The recessed lighting fixture of claim 2, comprising:

a light source slidable coupled to a slot defined by the adjusting bracket, the slot configured to provide a slidable coupling for supporting the light source in the plurality of positions relative to the opening.

6. The recessed lighting fixture of claim 1, wherein the adjusting bracket is pivotally connected to the base about a single axis parallel to the base plane.

7. The recessed lighting fixture of claim 1, comprising:

a connector selectively locking the adjusting bracket relative to the base.

8. The recessed lighting fixture of claim 1, comprising:

a lighting device driver electrically coupled to the light source.

9. The recessed lighting fixture of claim 1, wherein the adjusting bracket is pivotally connected to the base using a hinge pin.

10. A recessed lighting support mechanism, comprising:

a base defining a base plane; and a support bracket hinged to the base by at least one hinge and configured to support a light source by an adjustable coupling, the adjustable coupling configured to provide adjustment of the angle that light is emitted from the light source relative to the support bracket and to provide movement of the light source to a plurality of locations at different angular positions relative to the base while the support bracket remains stationary in relation to the base;

wherein the support bracket rotates about the at least one hinge connecting the base to the support bracket between a first rotated position and a second rotated position; and wherein the support bracket rotates about an axis perpendicular to the base plane.

11. The recessed lighting support mechanism of claim 10, comprising:

an opening in the base defining a central axis.

12. The recessed lighting support mechanism of claim 11, wherein the support bracket intersects the central axis in the first rotated position and does not intersect the central axis in the second rotated position.

13. The recessed lighting support mechanism of claim 11, comprising:

a supporting member, wherein the base is rotatably disposed on the supporting member and is rotatable about the central axis.

14. The recessed lighting support mechanism of claim 10, comprising:

a light source slidably coupled to a slot defined by the support bracket, the coupling providing movement of the light source relative to the support bracket.

15. The recessed lighting support mechanism of claim 14, wherein the slot includes at least one detent capable of accepting a pin to secure the light source in a preset position.

16. The recessed lighting support mechanism of claim 14, wherein the slot has a length and the support bracket is planar along the length of the slot, and wherein the support bracket is a single-blade support bracket.

17. A method of manufacturing a recessed lighting fixture, the method comprising the acts of:

providing a support base with an opening to allow passage of light from a light source;

providing an adjusting bracket configured to support the light source, the adjusting bracket having a plurality of mounting locations defining a plane, wherein the light source is constrained to aim in a different direction when the light source is located at different mounting locations;

connecting the light source to one of the plurality of mounting locations on the adjusting bracket; and connecting the adjusting bracket to the support base using a hinged connection to provide the capability of pivoting the adjusting bracket in a direction perpendicular to the plane defined by the mounting locations and into a plurality of pivot positions relative to the support base.

18. The method of manufacturing a recessed lighting fixture of claim 17, comprising:

inserting a connector between the adjusting bracket and the support base to secure the adjusting bracket.

19. The method of manufacturing a recessed lighting fixture of claim 17, comprising:

providing a slot in the adjusting bracket to allow movement of the light source relative to the opening, and wherein the adjusting bracket is a single-blade adjusting bracket.

20. The method of manufacturing a recessed lighting fixture of claim 17, comprising:

rotatably connecting a support member to the support base, wherein the support member rotates about a central axis defined by the opening to provide the adjustment of the angle that the light is emitted from the light source relative to the opening.

* * * * *